US010202220B2

(12) United States Patent
Reichenberg

(10) Patent No.: US 10,202,220 B2
(45) Date of Patent: Feb. 12, 2019

(54) SHIPPING CONTAINER AND DIVIDER FOR THE SAME

(71) Applicant: Summit Container Corporation, Monument, CO (US)

(72) Inventor: Daniel Kenneth Reichenberg, Monument, CO (US)

(73) Assignee: Summit Packaging Solutions, Alpharetta, GA (US)

( * ) Notice: Subject to any disclaimer, the term of this patent is extended or adjusted under 35 U.S.C. 154(b) by 108 days.

(21) Appl. No.: 15/448,049

(22) Filed: Mar. 2, 2017

(65) Prior Publication Data

US 2017/0334599 A1 Nov. 23, 2017

Related U.S. Application Data

(60) Provisional application No. 62/302,578, filed on Mar. 2, 2016.

(51) Int. Cl.
*B65D 5/49* (2006.01)
*B65D 5/42* (2006.01)

(52) U.S. Cl.
CPC ..... *B65D 5/48042* (2013.01); *B65D 5/4266* (2013.01); *B65D 5/48034* (2013.01)

(58) Field of Classification Search
CPC ..... B65D 5/48042; B65D 5/4266; B65D 5/48034; B65D 5/48028; B31D 5/0013
USPC ..... 229/120.26, 120.24, 120.25, 120.38, 229/120.28, 120.29, 120.02; 220/529
See application file for complete search history.

(56) References Cited

U.S. PATENT DOCUMENTS

| | | | | |
|---|---|---|---|---|
| 1,737,950 A | | 12/1929 | Scotland | |
| 1,859,537 A | | 5/1932 | Shofer | |
| 1,890,965 A | | 12/1932 | Boeye | |
| 2,078,907 A | | 4/1937 | Kondolf | |
| 3,115,290 A | | 12/1963 | Byassee | |
| 3,184,142 A | | 5/1965 | Rosenburg | |
| 3,626,494 A | * | 12/1971 | Levin | B65D 5/48028 229/120.26 |
| 4,251,020 A | * | 2/1981 | Schwaner | B65D 5/4804 229/120.24 |
| 4,280,650 A | * | 7/1981 | Gardner | B65D 5/48034 229/120.26 |
| 4,335,842 A | | 6/1982 | Bradford et al. | |

(Continued)

OTHER PUBLICATIONS

Fibre Box Handbook, Fibre Box Association, www.fibrebox.org, pp. 2, 2005.

*Primary Examiner* — Christopher Demeree
(74) *Attorney, Agent, or Firm* — Wiley Rein LLP

(57) ABSTRACT

A divider for a shipping container is formed from a single sheet of material. The divider includes a front panel having a plurality of feet; a first platform panel attached to the front panel along a first fold line; at least one divider assembly, and a rear panel having a plurality of feet. Each divider assembly in turn includes a divider interconnector panel to interconnect the divider assembly to a preceding panel; a divider wall panel attached to the divider interconnector panel along an interconnector-wall fold line; and a divider platform panel attached to the divider wall panel along a wall-platform fold line. The at least one divider assembly is attached to the first platform panel along a first divider assembly fold line and to the rear panel along a final divider assembly fold line.

20 Claims, 3 Drawing Sheets

(56) References Cited

U.S. PATENT DOCUMENTS

| | | | | | |
|---|---|---|---|---|---|
| 4,417,684 | A * | 11/1983 | Skaggs | B65D 5/48028 229/120.27 |
| 4,482,055 | A | 11/1984 | Boyle | |
| 4,498,420 | A | 2/1985 | Botterman et al. | |
| 4,775,097 | A * | 10/1988 | Katzman | B65D 5/32 229/120.26 |
| 5,495,983 | A | 3/1996 | Lelek | |
| 6,012,630 | A | 1/2000 | Block | |
| 6,669,082 | B1 * | 12/2003 | Meyer | B65D 5/48038 229/120.29 |
| 7,219,797 | B2 | 5/2007 | Kroeze et al. | |
| 7,410,094 | B2 * | 8/2008 | Bos | B65D 5/48038 220/529 |
| 8,770,467 | B2 * | 7/2014 | Skolik | B65D 5/48036 229/120.24 |
| 2003/0146269 | A1 | 8/2003 | Auclair et al. | |
| 2009/0084835 | A1 | 4/2009 | Tibbels et al. | |
| 2016/0046404 | A1 * | 2/2016 | Cheeser | B65D 5/48028 229/120.32 |
| 2018/0127198 | A1 * | 5/2018 | Workman | B65D 85/70 |

* cited by examiner

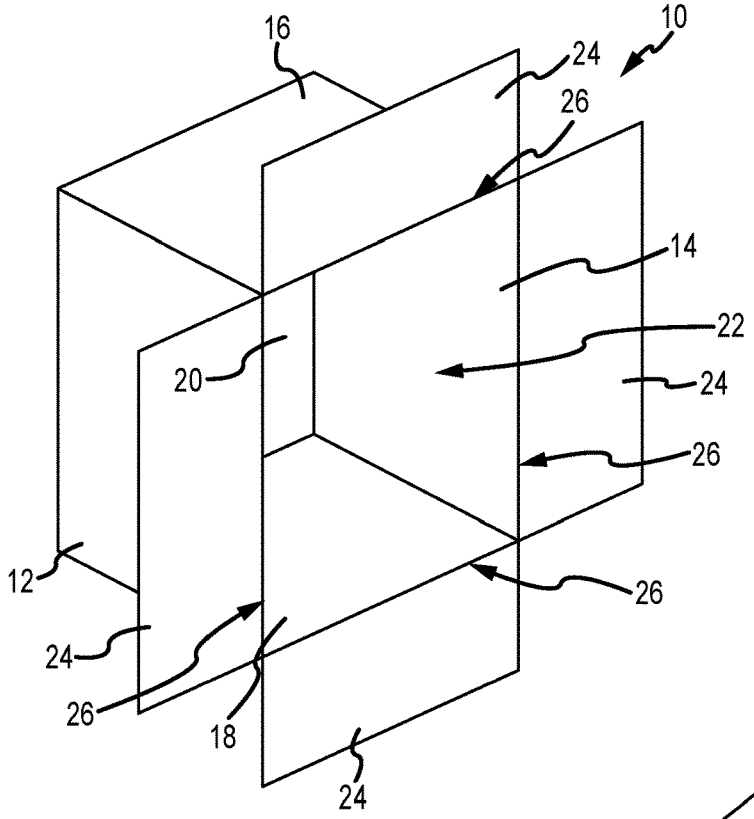
FIG.1
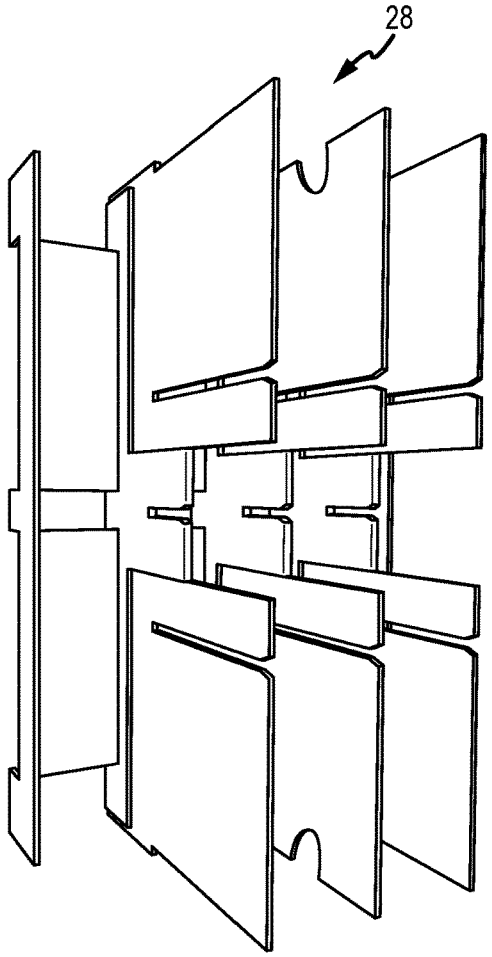

SHIPPING CONTAINER AND DIVIDER FOR THE SAME

CROSS-REFERENCE TO RELATED APPLICATIONS

This application claims the benefit of United States provisional application no. 62/302,578, filed 2 Mar. 2016, which is hereby incorporated by reference as though fully set forth herein.

BACKGROUND

The instant disclosure relates to shipping containers. In particular, the instant disclosure relates to a one-piece divider that both separates the interior of the shipping container into a plurality of compartments and that elevates the contents of the shipping container off the bottom thereof Boxes with partitions for separating multiple products within the box are known. Dividers or partitions can minimize the potential for a product being scraped or otherwise injured by other products shipped in the same box. For example, divided boxes to hold glassware will be familiar to anyone who has moved from one home to another. As another example, electronic components, such as television set top boxes, are often shipped in multi-compartment boxes. Typically, however, the dividers that are used to separate the box into a plurality of discrete chambers are multi-piece, adding to the complexity of assembling the box in the first instance.

Those of ordinary skill in the art will also recognize that it is desirable to elevate the contents of a box off the bottom of the box, for example to ensure that, when the box is set on a hard surface, the contents do not get damaged by vibration or shock. Many extant boxes utilize separate padding, placed along the bottom of the box, for this purpose. Like multi-piece dividers, the use of separate padding adds to the complexity of assembling the box in the first instance.

Moreover, the complexity of assembly is compounded when both multi-piece dividers and separate padding are used.

It would be desirable to provide a one-piece insert for a shipping container that both divides the shipping container into a plurality of compartments and elevates the contents of the shipping container above the bottom thereof.

BRIEF SUMMARY

Disclosed herein is a shipping container, including a box and a one-piece divider. The box includes a front wall, a rear wall, a pair of opposing sidewalls, and a bottom wall, wherein the front wall, the rear wall, the pair of opposing sidewalls, and the bottom wall define a box interior. The one-piece divider includes: a front panel including a plurality of feet; a first platform panel attached to the front panel along a first fold line; at least one divider assembly; and a rear panel including a plurality of feet. In turn, each divider assembly of the at least one divider assembly includes: a divider interconnector panel; a divider wall panel attached to the diver interconnector panel along an interconnector-wall fold line; and a divider platform panel attached to the divider wall panel along a wall-platform fold line. The at least one divider assembly is attached to the first platform panel along a first divider assembly fold line and to the rear panel along a final divider assembly fold line. The one-piece divider is disposed within the box interior such that: the front panel is adjacent and parallel to the front wall of the box; the rear panel is adjacent and parallel to the rear wall of the box; the divider interconnector panel and the divider wall panel of each divider assembly of the at least one divider assembly are parallel to and between the front wall and the rear wall; and the divider platform panel of each divider assembly of the at least one divider assembly and the first platform panel are parallel to and separated from the bottom wall of the box by the plurality of feet of the front panel and the rear panel, such that the one-piece divider divides the box interior into a plurality of compartments, each extending between the pair of opposing sidewalls. Each compartment also includes a platform panel that is spaced apart from the bottom wall of the box.

According to aspects of the disclosure, the number compartments into which the one-piece divider divides the box is one greater than a number of divider assemblies in the at least one divider assembly (e.g., a single divider assembly will result in two compartments).

Each divider assembly of the at least one divider assembly can also include a plurality of feet, which can be on the divider interconnector panel and/or the divider wall panel.

In embodiments, the at least one divider assembly includes a plurality of divider assemblies including a first divider assembly and a final divider assembly. According to such embodiments, the divider interconnector panel of the first divider assembly can be attached to the first platform panel along the first divider assembly fold line and the divider platform panel of the final divider assembly can be attached to the rear panel along the final divider assembly fold line.

It is also contemplated that the divider wall panel of each divider assembly of the at least one divider assembly can include at least one slot, and, in some aspects, at least two slots, configured to receive at least one cross-divider panel perpendicular to the front wall and the rear wall. Alternatively or additionally, the divider interconnector panel of each divider assembly of the at least one divider assembly can include a slot configured to receive at least one cross-divider panel perpendicular to the front wall and the rear wall.

In other aspects of the disclosure, each divider assembly of the at least one divider assembly includes at least one slot, and the shipping container includes at least one cross-divider panel inserted within the at least one slot such that the at least one cross-divider panel is perpendicular to the front wall and the rear wall, thereby dividing at least one compartment of the plurality of compartments into a plurality of sub-compartments.

Also disclosed herein is a one-piece divider for a shipping container, including: a front panel including a plurality of feet; a first platform panel attached to the front panel along a first fold line; at least one divider assembly, each divider assembly of the at least one divider assembly including: a divider interconnector panel; a divider wall panel attached to the divider interconnector panel along an interconnector-wall fold line; and a divider platform panel attached to the divider wall panel along a wall-platform fold line; and a rear panel including a plurality of feet, wherein the at least one divider assembly is attached to the first platform panel along a first divider assembly fold line and to the rear panel along a final divider assembly fold line. The at least one divider assembly can also include a plurality of feet, which can extend from the divider interconnector panel and/or the divider wall panel.

According to further aspects of the disclosure, the divider platform panel of the at least one divider assembly includes a first divider sub-platform and a second divider sub-platform, which are separated by one of the plurality of feet of the at least one divider assembly.

In additional embodiments, the at least one divider assembly includes a plurality of divider assemblies including a first divider assembly and a final divider assembly, the divider interconnector panel of the first divider assembly is attached to the first platform panel along the first divider assembly fold line; and the divider platform panel of the final divider assembly is attached to the rear panel along the final divider assembly fold line.

In still further aspects of the disclosure, the first platform panel includes a first platform sub-panel and a second platform sub-panel, which are separated by one of the plurality of feet of the front panel.

Yet another embodiment disclosed herein is a blank for a one-piece divider for a shipping container, the blank including: a front panel including a plurality of feet; a first platform panel attached to the front panel along a first fold line; at least one divider assembly, each divider assembly of the at least one divider assembly including: a divider interconnector panel; a divider wall panel attached to the divider interconnector panel along an interconnector-wall fold line; and a divider platform panel attached to the divider wall panel along a wall-platform fold line; and a rear panel including a plurality of feet, wherein the at least one divider assembly is attached to the first platform panel along a first divider assembly fold line and to the rear panel along a final divider assembly fold line, wherein the blank has a first configuration and a second configuration, wherein the first configuration of the blank is substantially flat, and wherein, when the blank is folded into the second configuration, the first platform panel and the divider platform panel of each divider assembly of the at least one divider assembly are oriented perpendicular to the front panel, the rear panel, and the divider interconnector panel and the divider wall panel of each divider assembly of the at least one divider assembly. The at least one divider assembly can optionally include a plurality of feet, which can be formed with the divider interconnector panel of the at least one divider assembly and/or with the divider wall panel of the at least one divider assembly.

The at least one divider panel assembly can also include a plurality of slots in at least one of the divider interconnector panel and the divider wall panel such that, when the blank is folded into the second configuration, the plurality of slots are oriented to receive a plurality of cross-divider panels extending orthogonal to the divider interconnector panel and the divider wall panel of the at least one divider panel.

The foregoing and other aspects, features, details, utilities, and advantages of the present invention will be apparent from reading the following description and claims, and from reviewing the accompanying drawings.

BRIEF DESCRIPTION OF THE DRAWINGS

FIG. 1 is a perspective view of a box and one-piece divider according to embodiments of the present disclosure.

DETAILED DESCRIPTION

Figure 2:
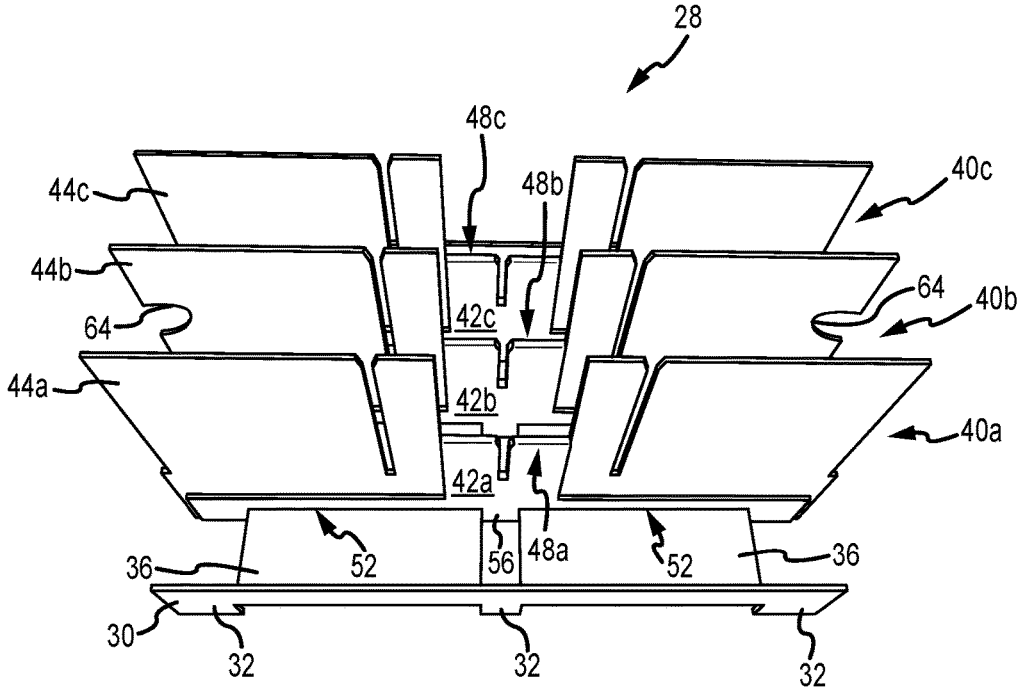
FIG. 2 is a perspective view of a one-piece divider according to embodiments of the present disclosure.

FIG. 1 shows a box 10, which includes a front wall 12, a rear wall 14, a pair of opposing sidewalls 16, 18, and a bottom wall 20 (in FIG. 1, box 10 is turned on its side). Together, front wall 12, rear wall 14, sidewalls 16, 18, and bottom wall 20 define a box interior 22.

As those of ordinary skill in the art will appreciate, bottom wall 20 can be formed by a plurality of bottom flaps that are attached to front wall 12, rear wall 14, and/or sidewalls 16, 18 along corresponding bottom flap fold lines. Likewise, a plurality of top flaps 24 can also be attached to front wall 12, rear wall 14, and/or sidewalls 16, 18 along corresponding top flap fold lines 26 in order to provide a closure for box 10. Insofar as various constructions of box 10 will be familiar to those of ordinary skill in the art, box 10 is only further described herein to the extent necessary to understand the present invention.

FIG. 1 also shows a one-piece divider 28, which can be received into interior 22 of box 10 in order to divide interior 22 of box 10 into a plurality of compartments, as further described below. Box 10 and divider 28 are referred to collectively herein as a "shipping container."

For purposes of explanation, certain embodiments of a shipping container according to the disclosure will be explained with reference to a shipping container for electronic components, such as television set-top boxes. It should be understood, however, that the teachings herein can be applied to good advantage in other contexts, such as shipping containers for other fragile or sensitive items, such as glassware.

Additional details of the construction of divider 28 will be described with reference to FIGS. 2 and 3. As shown in FIG. 3, divider 28 can be formed of a single sheet (or "blank"), which can be made of cardboard, corrugated paper, or another semi-rigid material. FIG. 3 shows the blank in a first, substantially flat configuration.

As further described below, the blank can be scored into several panels that remain attached to each other, but that can be easily folded along the resulting fold lines to assemble divider 28 for insertion into interior 22 of box 10. This second configuration of the blank is shown in FIG. 2.

According to aspects of the instant disclosure, divider 28 includes a front panel 30. Front panel 30 includes a plurality of feet 32. Likewise, divider 28 includes a rear panel 34, which also includes a plurality of feet 32.

A first platform panel 36 is attached to front panel 30 along a first fold line 38. In some embodiments, first platform panel 36 includes two or more sub-panels, which can be separated from each other by one or more of the plurality of feet 32 of front panel 30.

Interposed between first platform panel 36 and rear panel 34 are one or more divider assemblies 40. Each divider assembly 40 includes a divider interconnector panel 42, a divider wall panel 44, and a divider platform panel 46. Within a given divider assembly 40, divider wall panel 44 is attached to divider interconnector panel 42 along an interconnector-wall fold line 48, and divider platform panel 46 is attached to divider wall panel along a wall-platform fold line 50.

In embodiments of the disclosure, the divider assemblies 40 are attached to first platform panel 36 along a first divider assembly fold line 52 and to rear panel 34 along a final divider assembly fold line 54. Thus, a first divider assembly of the divider assemblies 40 can be attached to first platform panel 36 along first divider assembly fold line 52, and a final divider assembly of the divider assemblies can be attached to rear panel 34 along final divider assembly fold line 54.

Figure 3:
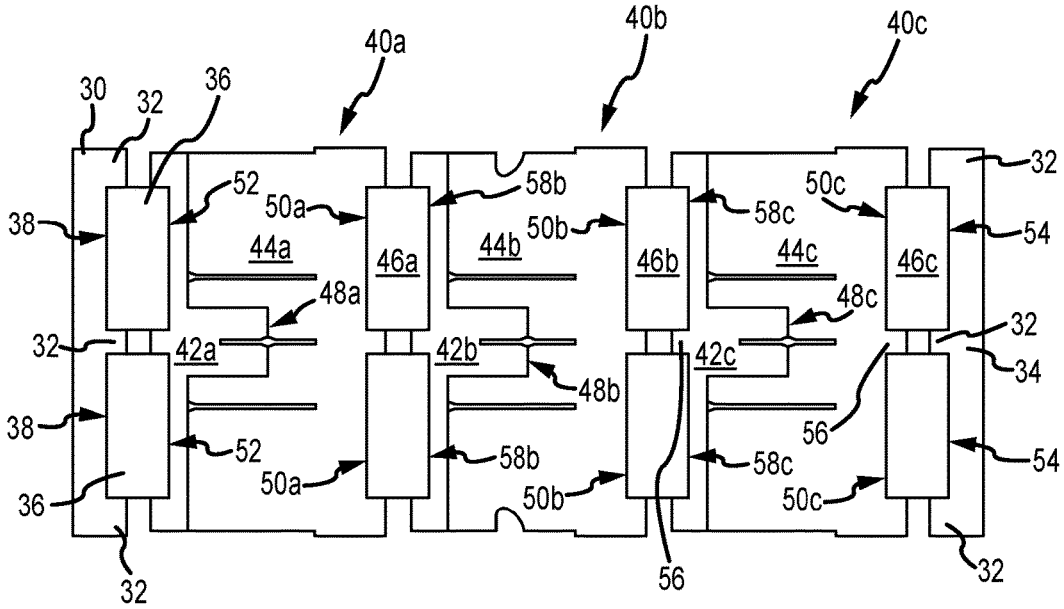
FIG. 3 depicts a blank for the one-piece divider shown in FIG. 2.

For purposes of illustration, three divider assemblies 40 are shown in FIGS. 2 and 3. These divider assemblies and their respective divider interconnector panels 42, divider wall panels 44, divider platform panels 46, and interconnector-wall and wall-platform fold lines 48, 50 are denoted with the letters "a," "b," and "c" following the more general reference numeral as described above. Thus, for purposes of illustration, divider assembly 40*a* can be referred to as the "first divider assembly" and divider assembly 40*c* can be referred to as the "final divider assembly." It should be understood, however, that any number of divider assemblies is within the scope of the instant disclosure dependent upon the number of compartments into which it is desirable to divide interior 22 of box 10 (e.g., the number of compartments will be one greater than the number of divider assemblies 40).

Divider assembly 40 can also include a plurality of feet 56 that are generally analogous to feet 32 on front panel 30 and/or rear panel 34. Feet 56 can be formed with and extend from divider interconnector panel 42 and/or divider wall panel 44 as desired. In addition, feet 56 can divide divider platform panels 46 into two or more sub-panels, in analogous fashion to the division of first platform panel 36 into two or more sub-panels by feet 32 attached to front panel 30.

The blank shown in FIG. 3 can be assembled into divider 28 by folding along the respective fold lines such that front panel 30, rear panel 34, divider interconnector panels 42*a*-42*c*, and divider wall panels 44*a*-44*c* are oriented generally perpendicular to first platform panel 36 and divider platform panels 46*a*-46*c*. In other words:

- Front panel 30 can be folded generally perpendicular to first platform panel 36 along first fold line 38 such that feet 32 of front panel 30 point downwards;
- Divider interconnector panel 42*a* can be folded generally perpendicular to first platform panel 36 along first divider assembly fold line 52 such that feet 56 of divider interconnector panel 42*a* point downwards;
- Divider wall panel 44*a* can be folded against divider interconnector panel 42*a* along interconnector-wall fold line 48*a* such that feet 56 of divider wall panel 44*a* point downwards;
- Divider platform panel 46*a* can be folded generally perpendicular to divider wall panel 44*a* along wall-platform fold line 50*a;*
- Divider interconnector panel 42*b* can be folded generally perpendicular to divider platform panel 46*a* along a platform-interconnector fold line 58*b* such that feet 56 of divider interconnector panel 42*b* point downwards;
- Divider wall panel 44*b* can be folded against divider interconnector panel 42*b* along interconnector-wall fold line 48*b* such that feet 56 of divider wall panel 44*b* point downwards;
- Divider platform panel 46*b* can be folded generally perpendicular to divider wall panel 44*b* along wall-platform fold line 50*b;*
- Divider interconnector panel 42*c* can be folded generally perpendicular to divider platform panel 46*b* along a platform-interconnector fold line 58*c* such that feet 56 of divider interconnector panel 42*c* point downwards;
- Divider wall panel 44*c* can be folded against divider interconnector panel 42*c* along interconnector-wall fold line 48*c* such that feet 56 of divider wall panel 44*c* point downwards;
- Divider platform panel 46*c* can be folded generally perpendicular to divider wall panel 44*c* along wall-platform fold line 50*c*; and
- Rear panel 34 can be folded generally perpendicular to divider platform panel 46*c* along final divider assembly fold line 54 such that feet 32 of rear panel 34 point downwards.

Once assembled, divider assembly 28 can be inserted into interior 22 of box 10. Front panel 30 will be adjacent and parallel to front wall 12; rear panel 34 will be adjacent and parallel to rear wall 14; and divider interconnector panels 42*a*-42*c* and divider wall panels 44*a*-44*c* will be generally parallel to and between front wall 12 and rear wall 14. Divider wall panels 44*a*-44*c* will extend generally from sidewall 16 to sidewall 18, which divides interior 22 of box 10 into a plurality of compartments (in the embodiments shown in FIGS. 2 and 3, interior 22 of box 10 will be divided into four compartments). This allows contents (e.g., television set-top boxes) to be placed into interior 22 of box 10 without coming into contact with each other (they will be separated by divider wall panels 44*a*-44*c*).

Similarly, first platform panel 36 and divider platform panels 46*a*-46*c* will extend generally parallel to bottom wall 20 and will be elevated therefrom by feet 32 and/or feet 56. This allows contents (e.g., television set-top boxes) to be placed into interior 22 of box 10 without coming into contact with bottom wall 20 thereof, which provides shock and vibration protection.

It may also be desirable to divide each compartment created by divider assembly 28 into two or more sub-compartments. Thus, in embodiments, divider interconnector panel 42 and/or divider wall panel 44 can include one or more slots 60 to receive one or more cross-divider panels 62, which can include corresponding slots to facilitate a close mating between cross-divider panels 62 and divider assembly 28. Once inserted, cross-divider panels 62 will extend generally parallel to sidewalls 16, 18 from front wall 12 to rear wall 14, thereby subdividing the compartments created by divider assembly 28 into a plurality of sub-compartments.

Figure 4:
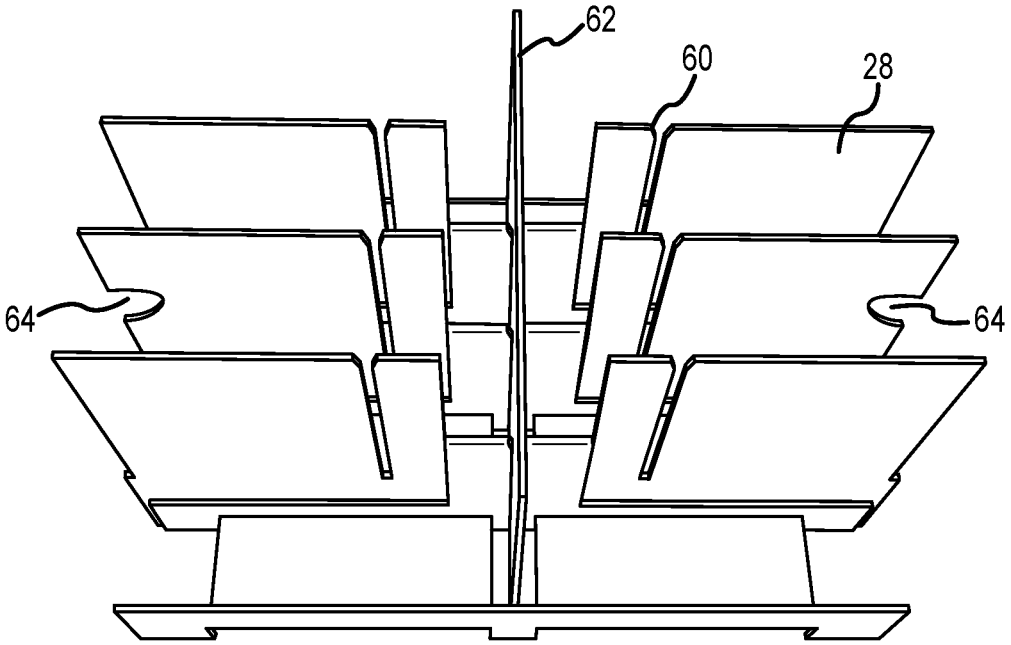
FIGS. 4 and 5 depict the usage of cross-divider panels with the one-piece divider shown in FIG. 2.

FIG. 4 depicts the use of one cross-divider panel 62, inserted into slots 60 in divider interconnector panels 42, which further divides the four compartments created by divider assembly 28 into eight sub-compartments.

Figure 5:
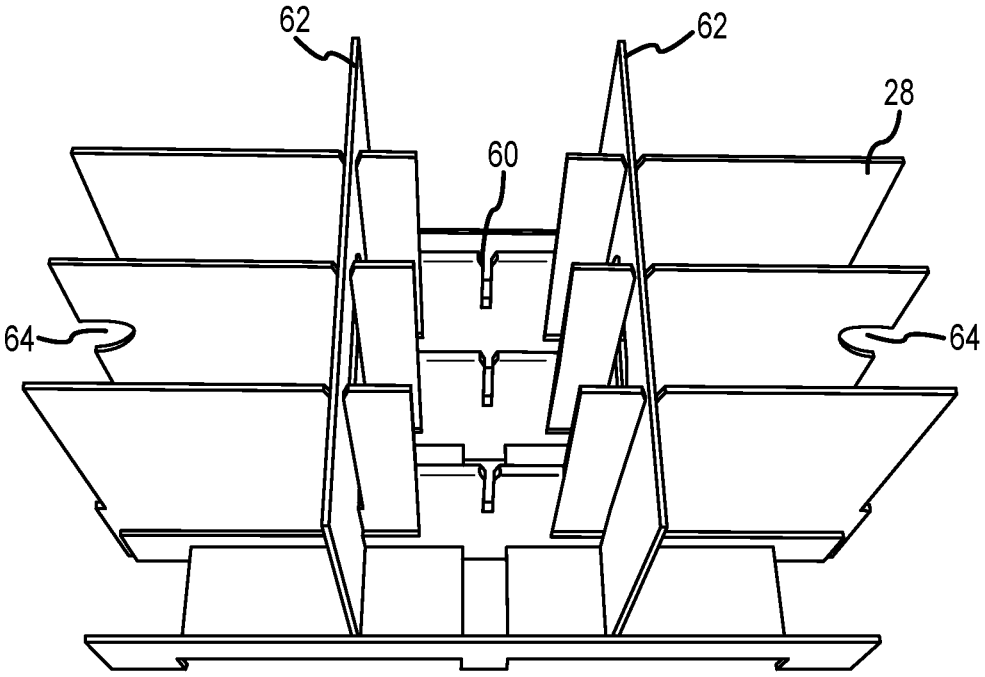

FIG. 5 depicts the use of two cross-divider panels 62, inserted into slots 60 in divider wall panels 44, which further divides the four compartments created by divider assembly 28 into twelve sub-compartments.

Of course, it is contemplated that additional cross-divider panels 62 could be used to even further divide the four compartments created by divider assembly 28, for example into sixteen sub-compartments, each of which is sized to receive a piece of glassware or another fragile item.

Although several embodiments of this invention have been described above with a certain degree of particularity, those skilled in the art could make numerous alterations to the disclosed embodiments without departing from the spirit or scope of this invention.

For example, it is known to provide cut-out handholds in sidewalls 16, 18 of box 10. To facilitate use of such handholds, the center-most divider wall panel 44 (e.g., divider wall panel 44*b*) can include corresponding cut-outs 64.

All directional references (e.g., upper, lower, upward, downward, left, right, leftward, rightward, top, bottom, above, below, vertical, horizontal, clockwise, and counterclockwise) are only used for identification purposes to aid the reader's understanding of the present invention, and do not create limitations, particularly as to the position, orientation, or use of the invention. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A shipping container, comprising:

a box including a front wall, a rear wall, a pair of opposing sidewalls, and a bottom wall, wherein the front wall, the rear wall, the pair of opposing sidewalls, and the bottom wall define a box interior, and;

a one-piece divider comprising:

a front panel including a plurality of feet;

a first platform panel attached to the front panel along a first fold line;

at least one divider assembly, each divider assembly of the at least one divider assembly comprising:

a divider interconnector panel;

a divider wall panel attached to the diver interconnector panel along an interconnector-wall fold line; and a divider platform panel attached to the divider wall panel along a wall-platform fold line; and a rear panel including a plurality of feet, wherein the at least one divider assembly is attached to the first platform panel along a first divider assembly fold line and to the rear panel along a final divider assembly fold line, wherein the one-piece divider is disposed within the box interior such that:

the front panel is adjacent and parallel to the front wall of the box;

the rear panel is adjacent and parallel to the rear wall of the box;

the divider interconnector panel and the divider wall panel of each divider assembly of the at least one divider assembly are parallel to and between the front wall and the rear wall; and the divider platform panel of each divider assembly of the at least one divider assembly and the first platform panel are parallel to and separated from the bottom wall of the box by the plurality of feet of the front panel and the rear panel, such that the one-piece divider divides the box interior into a plurality of compartments, each extending between the pair of opposing sidewalls.

2. The shipping container according to claim 1, wherein a number of the plurality of sub-compartments is one greater than a number of divider assemblies in the at least one divider assembly.

3. The shipping container according to claim 1, wherein each divider assembly of the at least one divider assembly further comprises a plurality of feet.

4. The shipping container according to claim 1, wherein:

the at least one divider assembly comprises a plurality of divider assemblies including a first divider assembly and a final divider assembly, the divider interconnector panel of the first divider assembly is attached to the first platform panel along the first divider assembly fold line; and the divider platform panel of the final divider assembly is attached to the rear panel along the final divider assembly fold line.

5. The shipping container according to claim 1, wherein the divider wall panel of each divider assembly of the at least one divider assembly further comprises at least one slot configured to receive at least one cross-divider panel perpendicular to the front wall and the rear wall.

6. The shipping container according to claim 5, wherein the at least one slot comprises at least two slots.

7. The shipping container according to claim 5, wherein the divider interconnector panel of each divider assembly of the at least one divider assembly further comprises a slot configured to receive at least one cross-divider panel perpendicular to the front wall and the rear wall.

8. The shipping container according to claim 1, wherein each divider assembly of the at least one divider assembly comprises at least one slot, and wherein the shipping container further comprises at least one cross-divider panel inserted within the at least one slot such that the at least one cross-divider panel is perpendicular to the front wall and the rear wall, thereby dividing at least one compartment of the plurality of compartments into a plurality of sub-compartments.

9. A one-piece divider for a shipping container, comprising:

a front panel including a plurality of feet;

a first platform panel attached to the front panel along a first fold line;

at least one divider assembly, each divider assembly of the at least one divider assembly comprising:

a divider interconnector panel;

a divider wall panel attached to the divider interconnector panel along an interconnector-wall fold line; and a divider platform panel attached to the divider wall panel along a wall-platform fold line; and a rear panel including a plurality of feet, wherein the at least one divider assembly is attached to the first platform panel along a first divider assembly fold line and to the rear panel along a final divider assembly fold line.

10. The one-piece divider according to claim 9, wherein the at least one divider assembly further comprises a plurality of feet.

11. The one-piece divider according to claim 10, wherein the plurality of feet of the at least one divider assembly extend from the divider interconnector panel.

12. The one-piece divider according to claim 10, wherein the plurality of feet of the at least one divider assembly extend from the divider wall panel.

13. The one-piece divider according to claim 10, wherein the divider platform panel of the at least one divider assembly comprises a first divider sub-platform and a second divider sub-platform, and wherein the first divider sub-platform and the second divider sub-platform are separated by one of the plurality of feet of the at least one divider assembly.

14. The one-piece divider according to claim 9, wherein:

the at least one divider assembly comprises a plurality of divider assemblies including a first divider assembly and a final divider assembly, the divider interconnector panel of the first divider assembly is attached to the first platform panel along the first divider assembly fold line; and the divider platform panel of the final divider assembly is attached to the rear panel along the final divider assembly fold line.

15. The one-piece divider according to claim 9, wherein the first platform panel comprises a first platform sub-panel and a second platform sub-panel, and wherein the first platform sub-panel and the second platform sub-panel are separated by one of the plurality of feet of the front panel.

16. A blank for a one-piece divider for a shipping container, the blank comprising:

a front panel including a plurality of feet;

a first platform panel attached to the front panel along a first fold line;

at least one divider assembly, each divider assembly of the at least one divider assembly comprising:

a divider interconnector panel;

a divider wall panel attached to the divider interconnector panel along an interconnector-wall fold line; and a divider platform panel attached to the divider wall panel along a wall-platform fold line; and a rear panel including a plurality of feet, wherein the at least one divider assembly is attached to the first platform panel along a first divider assembly fold line and to the rear panel along a final divider assembly fold line, wherein the blank has a first configuration and a second configuration, wherein the first configuration of the blank is substantially flat, and wherein, when the blank is folded into the second configuration, the first platform panel and the divider platform panel of each divider assembly of the at least one divider assembly are oriented perpendicular to the front panel, the rear panel, and the divider interconnector panel and the divider wall panel of each divider assembly of the at least one divider assembly.

17. The blank according to claim 16, wherein the at least one divider assembly further comprises a plurality of feet.

18. The blank according to claim17, wherein the plurality of feet of the at least one divider assembly are formed with the divider interconnector panel of the at least one divider assembly.

19. The blank according to claim 17, wherein the plurality of feet of the at least one divider assembly are formed with the divider wall panel of the at least one divider assembly.

20. The blank according to claim 16, wherein the at least one divider panel assembly comprises a plurality of slots in at least one of the divider interconnector panel and the divider wall panel such that, when the blank is folded into the second configuration, the plurality of slots are oriented to receive a plurality of cross-divider panels extending orthogonal to the divider interconnector panel and the divider wall panel of the at least one divider panel.

* * * * *